US009493895B2

(12) United States Patent
Tynkkynen et al.

(10) Patent No.: US 9,493,895 B2
(45) Date of Patent: Nov. 15, 2016

(54) DEVICE FOR TREATING A FIBER WEB

(71) Applicants: Topi Tynkkynen, Vantaa (FI); Tapio Pitkäniemi, Haarajoki (FI)

(72) Inventors: Topi Tynkkynen, Vantaa (FI); Tapio Pitkäniemi, Haarajoki (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 6 days.

(21) Appl. No.: 14/287,942

(22) Filed: May 27, 2014

(65) Prior Publication Data

US 2014/0353401 A1 Dec. 4, 2014

(30) Foreign Application Priority Data

May 28, 2013 (EP) ..... 13169463

(51) Int. Cl.

| | |
|---|---|
| ***D06B 1/02*** | (2006.01) |
| ***B05B 1/14*** | (2006.01) |
| ***B05B 15/02*** | (2006.01) |
| ***B05B 1/02*** | (2006.01) |

(52) U.S. Cl.

CPC . *D06B 1/02* (2013.01); *B05B 1/02* (2013.01); *B05B 1/14* (2013.01); *B05B 15/025* (2013.01); *B05B 15/0258* (2013.01); *B05B 15/0266* (2013.01)

(58) Field of Classification Search

CPC ..... B05B 15/0258; B05B 15/025; B05B 15/0266; B05B 7/066; B05B 7/0458

USPC ..... 239/112, 8, 106, 108, 424.5, 423, 424

See application file for complete search history.

(56) References Cited

U.S. PATENT DOCUMENTS 3,790,086 A * 2/1974 Masai ..... B05B 7/0416 239/406
4,221,339 A * 9/1980 Yoshikawa ..... B05B 5/03 239/400
4,605,168 A * 8/1986 Tachi ..... B05B 5/0407 239/112
4,842,196 A * 6/1989 Moy ..... B05B 5/025 239/112

(Continued)

FOREIGN PATENT DOCUMENTS

DE 102006046568 A1 4/2008
EP 0021812 A1 1/1981

(Continued)

OTHER PUBLICATIONS

Extended European Search Report for EP13169463 dated Oct. 24, 2013.

*Primary Examiner* — Arthur O Hall
*Assistant Examiner* — Joseph A Greenlund
(74) *Attorney, Agent, or Firm* — Stiennon & Stiennon

(57) ABSTRACT

A device for treating a fiber web, especially a device for applying treatment substance for treating a moving fiber web, has at least one nozzle (10) comprising a channel (11) for the treatment substance, a frame part (12), a tip or end (13) of the nozzle (10) and a treatment substance opening (14) providing a treatment substance spray, which nozzle (10) has a tip groove area (20) adjacent to the treatment substance opening (14). The nozzle (10) has at least one opening next to or at the tip groove area (20) for providing a cleaning fluid flow comprising gas and/or liquid to the tip groove area.

18 Claims, 1 Drawing Sheet

(56) References Cited

U.S. PATENT DOCUMENTS 5,059,285 A * 10/1991 Winheim ..... D21F 7/008 162/207
5,092,760 A * 3/1992 Brown ..... F23D 11/10 239/132.5
5,351,886 A * 10/1994 Bull ..... B05B 15/0258 162/199
5,419,491 A * 5/1995 Breitsprecher ..... B05B 7/0815 239/294
5,435,491 A * 7/1995 Sakuma ..... B05B 7/0815 239/296
5,727,735 A * 3/1998 Baumann ..... B05B 1/3046 239/112
6,341,734 B1 * 1/2002 Van Der Steur ..... B05B 3/1064 239/112
6,494,387 B1 * 12/2002 Kaneko ..... B05B 7/066 239/296
6,866,207 B2 * 3/2005 Kangas ..... B05B 7/066 239/290
6,928,924 B2 * 8/2005 Miyauchi ..... B05B 7/02 101/147
6,957,781 B2 * 10/2005 Gowens ..... B05B 15/025 222/145.1
6,969,012 B2 * 11/2005 Kangas ..... B05B 7/10 239/398
7,820,011 B2 * 10/2010 Almi ..... B05B 7/10 162/207
7,861,651 B2 * 1/2011 Hansson ..... B41F 7/30 101/147
7,861,945 B2 * 1/2011 Yasuda ..... B05B 3/1014 239/112
8,001,889 B2 * 8/2011 Gaugenrieder ..... B05B 15/0258 101/147
8,425,721 B2 * 4/2013 Tynkkynen ..... B05B 15/0406 162/136
8,453,945 B2 * 6/2013 Wurz ..... B05B 7/0458 239/106
2007/0210186 A1 * 9/2007 Fenton ..... A62C 5/002 239/422
2010/0116900 A1 * 5/2010 Wurz ..... F23D 11/102 239/8
2010/0193602 A1 * 8/2010 Ballu ..... B05B 3/1057 239/224
2014/0246509 A1 * 9/2014 Fenton ..... A62C 31/02 239/8

FOREIGN PATENT DOCUMENTS

| | | | |
|---|---|---|---|
| EP | 1361045 | A1 | 11/2003 |
| EP | 1972442 | A1 | 9/2008 |
| EP | 13169463 | | 5/2013 |
| FI | 9401 | | 9/2011 |
| WO | 02072953 | A1 | 9/2002 |
| WO | 2005040497 | A1 | 5/2005 |
| WO | 2006058961 | A1 | 6/2006 |
| WO | 2007006004 | A2 | 1/2007 |
| WO | 2007006861 | A1 | 1/2007 |

* cited by examiner

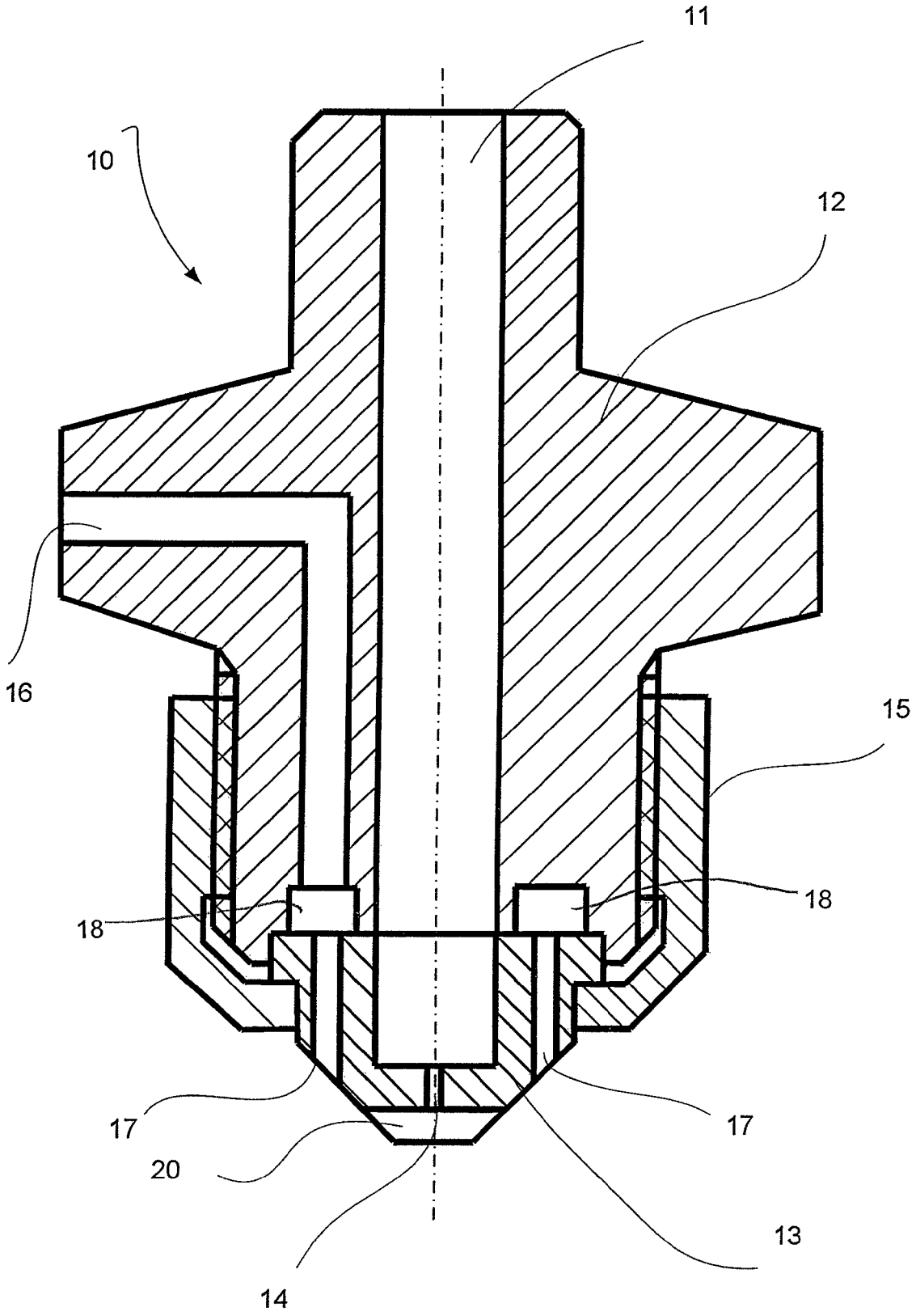
11
10
12
16
15
18
18
17
17
20
13
14

DEVICE FOR TREATING A FIBER WEB

CROSS REFERENCES TO RELATED APPLICATIONS

The present application claims priority on European Application No. EP 13169463, filed on May 28, 2013, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to treating a fiber web. Especially the invention relates to a device for applying treatment substance for treating a moving fiber web on at least one surface of the fiber web, especially a device for applying treatment substance for treating a moving fiber web, with a nozzle having a channel for the treatment substance, leading to a tip of the nozzle and an opening providing a treatment substance spray, which nozzle has a tip groove area adjacent to the treatment substance opening.

In WO publication 2006/058961 A1 is disclosed a method and arrangement for processing a paper or board web or similar fiber web. In this prior art method a processing mixture is spread on the surface of the web with spray nozzles. In the method the web to be processed is lead from a press nip and between rolls in this nip. Before the web enters the nip such an amount of processing mixture is spread onto at least one side of the web that the processing mixture is still wet when it enters the nip. In the prior art arrangement according to this publication the arrangement comprises at least one press nip, elements for taking the web to the press nip and elements for spreading the processing mixture and the element for spreading the processing mixture are spray nozzles which are arranged at an adjustable distance in the arrival direction of the web from the press nip to feed the processing mixture to at least one surface of the web.

In publication WO 02/072953 is disclosed an assembly for treating a moving web of paper or board with a web treatment substance which assembly comprises an application chamber located in a close vicinity of the moving web and facing the web, whereby the chamber is delineated by the web, the walls of the coater apparatus and sealing means and at least one linear nozzle array incorporating at least one nozzle for spraying the web treatment substance on the web and in which assembly also comprises a suction chamber adapted to communicate with the application chamber and means for removing mist and accumulations of the web treatment substance by way of establishing a flow in the suction chamber and the application chamber.

In FI utility model registration 9401 is disclosed a device for treating a fiber web, which comprises an application device, in particular a spraying device, for applying treatment substance on a moving fiber web, which application device comprises an application chamber and a channel for removing mist of the treatment substance from the application chamber and flow openings for blowing steam and/or air.

In WO publication 2007/006861 is disclosed a moistening nozzle, which comprises a frame to which air and water are fed. Inside the frame there is arranged a water nozzle wherewith the water is conducted to an outlet of the moistening nozzle. The air nozzle comprises means that bring the air into a swirling motion and a sleeve part having an opening through which the air is discharged and in said opening there is arranged a piece that is an integral part of the moistening nozzle frame, whereby the inner edge of the air gap formed by said piece and the sleeve part is provided by the moistening nozzle frame.

In U.S. Pat. No. 6,866,207 is disclosed an atomizer for paper making comprising elongated tubing, an intake orifice disposed on one end of said tubing, a nozzle assembly affixed to the opposite end of said tubing, a first nozzle element extending from said nozzle assembly at an angle with respect to the axis of said tubing, a swirl wheel and cone former concentrically disposed with respect to said tubing and adapted to receive propellant gas from said first nozzle element, and said cone former comprising a swirl ledge angled inwardly with respect to said axis of said tubing. This apparatus creates a continuous seamless spray of the desired liquid using the nozzle utilizing any single gas, steam, air or a mixture thereof as a motive gas or propellant.

In U.S. Pat. No. 6,969,012 is disclosed an atomizer for paper making comprising a housing, said housing having three inlets, three channels each including a nozzle in communication respectively with said inlets, said three inlets comprising a fluid-receiving first inlet, a fluid-receiving second inlet, a liquid-receiving third inlet, one of said channels being the innermost channel, said innermost channel being associated with said third inlet, the one of said nozzles associated with said innermost channel extending outwardly of said housing beyond the other two of said nozzles, and said innermost channel being uniform in diameter from said liquid-receiving third inlet to the outer end of said nozzle.

In WO publication 2005/040497 A1 is disclosed a device for treating a fiber web, especially a device for applying treatment substance for treating a moving fiber web on at least one surface of the fiber web, which device comprises at least one nozzle comprising a channel for the treatment substance and a tip or end of the nozzle for providing a treatment substance flow on the fiber web. The tip or end of the nozzle of the device for treating a fiber web is provided with means comprising insulation means and/or cooling means for managing the temperature of the tip or end of the nozzle.

One problem that may occur in connection with nozzles for applying heated treatment substance on the web in prior art devices for treating a fiber web is that some treatment substance may adhere at the tip or end of the nozzle due to the high temperature of the tip or end of the nozzle and thus disturb the flow of spray of the treatment substance causing an uneven application result. In worse cases the adhered substance amount is high and it may form lumps at the tip or end of the nozzle which lumps might drop on the fiber web causing a break or adhesion of fiber web reel-layers in connection with reeling.

SUMMARY OF THE INVENTION

Insulation of the tip or end of the nozzle has been found out to help in adherence problems. The treatment substance may still adhere to the tip groove area adjacent to the nozzle opening for the treatment substance, since during spraying the treatment substance the spray also removes air from the tip groove area and creates a lower pressure at the tip groove area, which tends to aspirate to the tip groove area replacement air from the surroundings, which surrounding air comprises also the substance to be sprayed. Thus an environment susceptible for adherence of the treatment substance is created. The adhered treatment substance in the tip groove area disturbs the flow of treatment substance causing uneven an application result and even blocks the nozzle opening.

An object of the invention is to create a device for treating a fiber web in which problems relating to the adhering of the treatment substance on the tip or end of the nozzle are eliminated or at least minimized.

In particular an object of the invention is to provide a device for treating a fiber web in which problems relating to the adhering of the treatment substance on the very end, especially in the tip groove of the nozzle, are eliminated or at least minimized.

In order to achieve the above object the device according to the invention has at least one opening next to or at the tip groove area for providing a cleaning fluid flow comprising gas and/or liquid to the tip groove area. Other advantageous embodiments and features of the invention are the flow velocity of the treatment substance is greater than the velocity of the cleaning fluid flow, the cleaning fluid is steam or water, and the cleaning fluid has a pressure of 10-50,000 Pa, and the tip or end of the nozzle is insulated or cooled to manage the temperature of the tip or end.

According to the invention in the device for treating a fiber web the nozzle is provided with at least one opening next to or at the tip groove area for providing a cleaning fluid flow comprising gas and/or liquid to the tip groove area.

The frame part of the nozzle comprises at least one channel for providing the cleaning fluid flow to the at least one opening.

By the invention replacement fluid is provided to the tip groove area adjacent to the nozzle opening for the treatment substance for the air removed by the treatment substance flow. Advantageously the cleaning fluid flow comprises steam and/or air and/or water. Advantageously the cleaning fluid comprises gas and liquid, most advantageously the cleaning fluid is steam, since by the moisture in the cleaning fluid flow a flushing effect is achieved in addition to the replacement gas/air effect.

According to the invention at least one opening for the cleaning fluid flow is arranged such that the cleaning fluid spray created does not interfere with the treatment substance flow by keeping the speed of the treatment substance flow higher than the speed of the cleaning fluid flow. The speed of the treatment substance is 15-175 m/s after the outlet opening of the nozzle and the speed of the cleaning fluid flow is 3-173 m/s. According to an advantageous feature of the invention the cleaning fluid flow is provided continuously during the operation of the nozzle.

Advantageously during maintenance breaks of the device the cleaning fluid flow is pressurized water for washing the tip or the end of the nozzle.

The at least one opening is formed such that desired cleaning fluid spray form is provided; advantageously the form of the opening for cleaning fluid is round or elliptic or a gap opening.

The pressure of the cleaning fluid flow is just before the opening for cleaning fluid 10-50,000 Pa, advantageously 20-4,000 Pa. Thus the amount of condensing water is minimized.

According to an advantageous feature of the invention the tip or end of the nozzle of the device for treating a fiber web is provided with means for managing the temperature of the tip or end of the nozzle by insulation means and/or cooling means for preventing the adhering of the heated treating substance. By the means for managing the temperature, the temperature of the tip or end of the nozzle is kept at such range that adhering of the treatment substance does not occur, advantageously the temperature of the tip or end of the nozzle is kept at a temperature range of 15-50° C. The suitable temperature is dependent on the properties of the treatment substance. Typically treatment a substance temperature range of 50-100° C. is suitable for instance for sizing agents, and a temperature range of 20-50° C. is suitable for instance for coating colors.

The treatment substance is, for example, sizing agent or coating color or starch or latex or polyvinyl acetate.

The invention is suitable for different types of nozzles used in connection with devices for treating a fiber web, for example spray nozzles, high pressure nozzles, air atomizing nozzles, pressure atomizing nozzles or low pressure nozzles.

BRIEF DESCRIPTION OF THE DRAWINGS

FIG. 1 is a cross-sectional schematic drawing of an example of the invention.

DESCRIPTION OF THE PREFERRED EMBODIMENTS

In the example of FIG. 1 the nozzle 10 comprises a frame part 12 to which the nozzle end 13 is attached by a connecting part 15, which can be made of insulating material. The nozzle 10 comprises a channel 11 for treatment substance that traverses the frame part 12 and the nozzle tip or end 13 to the nozzle opening 14 for the treatment substance spray. Adjacent to the nozzle opening is the tip groove area 20. The nozzle 10 further comprises according to the invention at least one opening 17 on the nozzle tip or end 13 for the cleaning fluid, which comprises steam and/or air and/or water. The cleaning fluid is passed to the opening 17 through at least one channel 16 that traverses the frame part 12 of the nozzle 10 to a plenum 18 and then to the cleaning fluid openings 17 in the nozzle tip or end 13.

We claim:

1. A device for treating a fiber web with a treatment substance comprising:

at least one nozzle having a tip or end having an outwardly facing tip surface located on an exterior of the nozzle, and a frame, portions of the frame forming a channel connected to a source of fiber web treatment substance;

wherein the at least one nozzle has portions forming a fiber web treatment substance opening for forming a spray of fiber web treatment substance positioned at the end or tip of the nozzle, and connected to the channel to receive fiber web treatment substance, the channel extending from the source of fiber web treatment substance to the fiber web treatment substance opening in a first direction;

wherein the at least one nozzle has a groove forming a groove area adjacent to the treatment substance opening, the groove extending transverse to the channel and downstream of the treatment substance opening, wherein the groove is adjacent the tip surface;

wherein the at least one nozzle has portions forming a first cleaning opening and a second cleaning opening next to or at the groove and connected to a source of cleaning fluid by parallel cleaning fluid channels which extend to a plenum in the frame which communicates with a second channel which extends to a source of cleaning fluid so as to supply a cleaning fluid flow to clean the groove area, wherein the at least one cleaning opening is located upstream in the first direction from the groove, and discharges to the tip surface; and wherein the nozzle tip groove extends between a first end and a second end, and wherein the first cleaning opening is adjacent the tip surface near the first end of the groove and the second cleaning opening is adjacent the tip surface near the second end of the groove, the first and second cleaning openings coinciding with the first and second ends of the groove.

2. The device of claim 1 wherein the source of cleaning fluid is a source of steam.

3. The device of claim 1 wherein the cleaning fluid flow comprises a cleaning fluid spray, and wherein the first and second cleaning openings are arranged such that cleaning fluid spray does not interfere with the spray of fiber web treatment substance by having the source of fiber web treatment substance be of a first selected pressure such that the first selected pressure with the fiber web treatment substance opening forms the spray of fiber web treatment substance having a first speed between 15-175 m/s and by having the source of cleaning fluid be of a second selected pressure such that the second selected pressure with the cleaning openings form the cleaning fluid flow having a second speed between 3-173 m/s which is less than the first speed.

4. The device of claim 1 wherein the cleaning fluid flow and the spray of fiber web treatment substance are arranged to operate at the same time.

5. The device of claim 1 wherein during maintenance breaks of the device the cleaning fluid flow is pressurized water for washing the tip of the nozzle.

6. The device of claim 1 wherein the form of the first and second cleaning openings is round or elliptic.

7. The device of claim 1 wherein the tip or end of the nozzle has a portion of lower thermal conductivity to insulate portions of the tip or end of the nozzle so as to manage the temperature of the tip or end of the nozzle.

8. The device of claim 1 wherein the fiber web treatment substance source is a source of sizing agent, coating color, starch, latex or polyvinyl acetate.

9. The device of claim 1 wherein the source of fiber web treatment substance is a source of sufficient pressure to atomize the fiber web treatment substance as it passes through the fiber web treatment substance opening.

10. The device of claim 1 wherein the source of cleaning fluid is a source of cleaning fluid at a pressure of 10-50,000 Pa.

11. The device of claim 10 wherein the source of cleaning fluid is a source of cleaning fluid at a pressure of 20-4,000 Pa.

12. A nozzle for treating a fiber web with a treatment substance comprising:

a frame having a first thermal conductivity, portions of the frame forming a first channel connected to a source of fiber web treatment substance;

a nozzle tip mounted to the frame, the nozzle tip having an outwardly facing tip surface located on an exterior of the nozzle tip, the nozzle tip having portions forming a treatment substance opening in fiber web treatment substance receiving relation to the first channel, and arranged to form a spray of fiber web treatment substance, and the nozzle tip having portions forming a groove to which the treatment substance opening extends, the groove defining a groove area which is adjacent the nozzle tip surface;

wherein the frame has portions forming a second channel connected to a source of cleaning fluid;

portions of the frame forming a cleaning fluid plenum in cleaning fluid receiving relation to the second channel;

wherein the nozzle tip has portions forming a first and a second cleaning fluid opening spaced from the treatment substance opening and communicating by parallel cleaning fluid channels with the cleaning fluid plenum, wherein the first and second cleaning fluid openings open to the tip surface for the discharge of cleaning fluid; and a connecting part formed of a material with a second thermal conductivity which is less than the first thermal conductivity, the connecting part mounting the nozzle tip to the frame; and wherein the nozzle tip groove extends between a first end and a second end, and wherein the first cleaning fluid opening is adjacent the tip surface near the first end of the groove and the second cleaning fluid opening is adjacent the tip surface near the second end of the groove, the first and second cleaning fluid openings coinciding with the first and second ends of the groove.

13. The nozzle of claim 12 wherein the source of cleaning fluid is a source of steam.

14. The nozzle of claim 12 wherein the nozzle tip portions forming the first and second cleaning fluid openings and portions forming a treatment substance opening are arranged to discharge a cleaning fluid flow and the spray of fiber web treatment substance at the same time.

15. The nozzle of claim 12 wherein the source of cleaning fluid is a source of pressurized water for washing the nozzle tip.

16. The nozzle of claim 12 wherein the source of fiber web treatment substance is a source of sufficient pressure to atomize the fiber web treatment substance as it passes through the treatment substance opening.

17. The nozzle of claim 12 wherein the source of cleaning fluid is a source of cleaning fluid at a pressure of 10-50,000 Pa.

18. A nozzle for treating a fiber web with a treatment substance comprising:

a frame, portions of the frame forming a first channel connected to a source of fiber web treatment substance;

a nozzle tip mounted to the frame, the nozzle tip having an outwardly facing tip surface located on an exterior of the nozzle tip, the nozzle tip having portions forming a treatment substance opening in fiber web treatment substance receiving relation to the first channel and arranged to form a spray of fiber web treatment substance, and wherein the nozzle tip has portions forming a groove to which the treatment substance opening extends, the groove extending to the tip surface;

wherein the nozzle tip has portions forming a first cleaning fluid opening and a second cleaning fluid opening, connected by parallel cleaning fluid channels to receive cleaning fluid from a plenum which is connected to a source of cleaning fluid, the cleaning fluid openings closely spaced from and upstream of the treatment substance opening, the cleaning fluid openings extending to the tip surface; and wherein the nozzle tip groove extends between a first end and a second end, and wherein the first cleaning fluid opening is adjacent the tip surface near the first end of the groove and the second cleaning fluid opening is adjacent the tip surface near the second end of the groove, the first and second cleaning fluid openings coinciding with the first and second ends of the groove.

* * * * *